US009427803B2

(12) United States Patent
Carrig et al.

(10) Patent No.: US 9,427,803 B2
(45) Date of Patent: Aug. 30, 2016

(54) ALLOY CASTING APPARATUS

(75) Inventors: John Francis Carrig, Heidelberg (AU); Geoffrey De Looze, Forest Hill (AU); Thang Tran Nguyen, Glen Iris (AU); Vladimir Nikolai Alguine, Moscow (RU)

(73) Assignee: Commonwealth Scientific and Industrial Research Organisation, Campbell, Australian Capital Territory (AU)

( * ) Notice: Subject to any disclaimer, the term of this patent is extended or adjusted under 35 U.S.C. 154(b) by 2403 days.

(21) Appl. No.: 11/661,803

(22) PCT Filed: Sep. 1, 2005

(86) PCT No.: PCT/AU2005/001315
§ 371 (c)(1),
(2), (4) Date: Mar. 13, 2008

(87) PCT Pub. No.: WO2006/024090
PCT Pub. Date: Mar. 9, 2006

(65) Prior Publication Data

US 2008/0257519 A1 Oct. 23, 2008

(30) Foreign Application Priority Data

Sep. 1, 2004 (AU) ..... 2004904994

(51) Int. Cl.
*B22D 41/04* (2006.01)
*B22D 23/00* (2006.01)

(52) U.S. Cl.
CPC ..... *B22D 23/006* (2013.01); *B22D 41/04* (2013.01)

(58) Field of Classification Search
None
See application file for complete search history.

(56) References Cited

U.S. PATENT DOCUMENTS

| | | | | |
|---|---|---|---|---|
| 2,024,854 A | | 12/1935 | George | |
| 2,186,938 A | | 1/1940 | McWane | |
| 2,195,960 A | | 4/1940 | Morris | |
| 2,309,608 A | | 1/1943 | Wessel | |
| 2,429,146 A | | 10/1947 | Wessel | |
| 2,546,517 A | | 3/1951 | Norman | |
| 3,019,495 A | * | 2/1962 | Cornell | 164/62 |
| 3,311,361 A | * | 3/1967 | Zepernick | 266/240 |
| 3,452,805 A | | 7/1969 | Morin | |

(Continued)

FOREIGN PATENT DOCUMENTS

| | | |
|---|---|---|
| AT | 82858 | 2/1921 |
| CH | 359844 | 1/1962 |

(Continued)

OTHER PUBLICATIONS

Machine translation of DE 2056243 (published May 18, 1972).*

*Primary Examiner* — Kevin E Yoon
*Assistant Examiner* — Jacky Yuen
(74) *Attorney, Agent, or Firm* — Merchant & Gould P.C.

(57) ABSTRACT

Apparatus for gravity flow and feeding of alloy in a casting operation has a supply vessel for holding a supply of alloy, a furnace in which the vessel is contained and in which the vessel is heatable to maintain the supply of alloy at suitable casting temperature, and a die mounted laterally outwardly from the vessel in relation to the furnace. A conduit provides communication between the vessel and the die. The apparatus further includes means for reversibly tilting an assembly including the furnace, the vessel and the die about a substantially horizontal axis to enable or prevent the flow of the alloy from the vessel to a die cavity defined by the die.

21 Claims, 8 Drawing Sheets

(56) References Cited

U.S. PATENT DOCUMENTS

| | | | | | |
|---|---|---|---|---|---|
| 3,472,942 | A * | 10/1969 | Campbell | B22D 17/28 | 164/335 |
| 3,810,564 | A * | 5/1974 | Allyn et al. | 222/146.2 | |
| 3,863,704 | A | 2/1975 | Kahn | 164/130 | |
| 3,960,202 | A | 6/1976 | Jorgensen | 164/325 | |
| 4,478,270 | A * | 10/1984 | Rosenthal et al. | 164/254 | |
| 4,616,689 | A | 10/1986 | Denis | 164/34 | |
| 4,733,714 | A | 3/1988 | Smith | 164/130 | |
| 5,524,700 | A | 6/1996 | Gosch | 164/136 | |
| 5,626,180 | A | 5/1997 | Kahn et al. | 164/136 | |
| 5,704,413 | A | 1/1998 | Takasaki et al. | 164/136 | |
| 5,735,334 | A | 4/1998 | Sutton et al. | 164/130 | |
| 6,334,975 | B1 | 1/2002 | Yokote et al. | 266/94 | |
| 2004/0065429 | A1 | 4/2004 | Osugi et al. | 164/335 | |

FOREIGN PATENT DOCUMENTS

| | | | | |
|---|---|---|---|---|
| DE | 322169 | | 6/1920 | |
| DE | 377683 | | 6/1923 | |
| DE | 505224 | | 8/1930 | |
| DE | 2833569 | | 7/1931 | |
| DE | 1218122 | | 11/1960 | |
| DE | 1201954 | | 12/1963 | |
| DE | 1508812 | | 11/1966 | |
| DE | 20 56 243 | | 5/1972 | |
| DE | 3401354 | A1 * | 7/1985 | B22D 15/00 |
| DE | 3644701 | | 12/1986 | |
| EP | 0199711 | | 10/1986 | |
| EP | 0657236 | | 6/1995 | |
| FR | 996838 | | 8/1949 | |
| FR | 2533847 | A1 * | 4/1984 | B22D 18/04 |
| GB | 178091 | | 8/1922 | |
| GB | 280963 | | 6/1928 | |
| GB | 820689 | | 9/1959 | |
| GB | 967500 | | 8/1964 | |
| GB | 1588592 | | 4/1981 | |
| GB | 2057937 | | 4/1981 | |
| JP | 55-86673 | | 6/1980 | |
| JP | 59225873 | A * | 12/1984 | |
| JP | 03-118956 | | 5/1991 | |
| JP | 5-146861 | | 6/1993 | |
| JP | 6/114523 | | 4/1994 | |
| JP | 06-320255 | | 11/1994 | |
| JP | 2000-042716 | | 2/2000 | |
| JP | 2003-117650 | | 4/2003 | |

* cited by examiner 150
105a
148
90
104a
102
106
118
92
104a
90
146
105a
103
103a
105
104
106
103
108
107
103b
90
91
104
109
113
103d
111
105
103c
105
103

ALLOY CASTING APPARATUS

This is a national stage of PCT/AU2005/001315 filed 1 Sep. 2005 and published in English.

FIELD OF THE INVENTION

This invention relates to alloy casting apparatus.

BACKGROUND TO THE INVENTION

There is a need for a versatile gravity casting apparatus which is well suited to the needs of foundries for economical production of high integrity components. The present invention is directed to meeting that need and, in particular, to provide casting apparatus useful in the production of castings of magnesium alloys.

GENERAL SUMMARY OF THE INVENTION

The casting apparatus provided by the present invention has a reversibly pivotable assembly which enables gravity flow and feeding of alloy in a casting operation. The assembly includes an alloy supply vessel, in the form of a reservoir pot, retort or tank, a furnace in which the vessel is contained, and a die with which the vessel is in communication. The assembly is tiltable in one direction about a substantially horizontal axis to enable the flow of alloy to at least one die cavity defined by the die and in the opposite direction to prevent that flow.

The apparatus can be adapted or suitable for use with any gravity castable alloy. However, it is particularly suited for use with magnesium and magnesium alloys, herein collectively referred to as magnesium alloy. This is because the apparatus enables particular issues involved in handling and casting molten magnesium alloy to be accommodated. Thus, while the invention can have wider application, it principally is described herein with reference to magnesium alloy.

The casting apparatus according to the present invention has a supply vessel for holding a supply of alloy, a furnace in which the vessel is contained and in which the vessel is heatable to maintain the supply of alloy at a suitable casting temperature, a die mounted laterally outwardly from the vessel and on or in relation to the furnace, a conduit providing communication between the vessel and the die, and means for reversibly tilting an assembly including the furnace, the vessel and the die about a substantially horizontal axis to enable or prevent the flow of the alloy from the vessel to a die cavity defined by the die.

In the apparatus, the means for reversibly tilting the assembly may be capable of operating in at least the first of two possible modes. The first of the two modes is able to be used for operation of the apparatus in a number of repeated casting cycles. In the first mode, the assembly is tiltable between a first, non-casting position it occupies on completion of one cycle and before commencement of the next cycle and in which the flow of alloy from the vessel to the die is prevented, and a second, casting position enabling flow from the vessel to the die. The second mode is able to be used on completion of a casting run or to enable maintenance or repair of the apparatus. In the second mode, the assembly is tiltable to a third storage position which is beyond the non-casting position in a direction away from the casting position. When the assembly is in the storage position alloy retained in the conduit during pivoting in the first mode is able to drain back into the vessel.

The vessel may be able to hold a volume of molten alloy which is substantially larger than the volume of alloy consumed in a casting cycle. Preferably the vessel is able to receive fresh alloy as required to maintain an upper free surface of the alloy at a substantially constant level relative to the vessel when the assembly is in the non-casting position. However, the alloy surface may vary from a constant level within a relatively narrow range. The magnitude of that range can vary with the size of the apparatus, but can for example be not more than about ±30 mm, such as about ±15 mm of a desirable level. Alloy may be supplied to the vessel from a larger holding furnace, adjacent to the apparatus, such as by a syphon action. Alternatively, alloy may be added to the vessel from time to time, when necessary between successive cycles, such as by adding solid alloy to be melted in the vessel.

The positions to which the assembly is tiltable may be attained by pivoting to fixed angular positions. This includes each of the three positions detailed above, as well as a fourth position detailed later herein. However there can be benefit in the assembly being able to be tilted from the non-casting position to the casting position through an angle which increases sufficiently in successive casting cycles to achieve a substantially uniform pressure head for each cycle. That is, the increase in tilting angle can be designed to allow for the loss of molten metal in each casting cycle. Of course there are limits to the number of cycles over which increased tilting angle is practical before it is necessary to increase the volume of alloy in the vessel.

In one form, the conduit has a first end at the vessel at a location which most preferably is below the level of alloy in the vessel when the assembly is in the non-casting position. The arrangement is such that a pressure head of molten alloy above that location is able to be maintained during pivoting of the assembly in the first mode and such that the pressure head of alloy increases as the assembly tilts from the non-casting to the casting position. With the assembly in the casting position, the pressure head reaches a maximum, with the level of alloy in the vessel sufficiently above the highest point in the die cavity to ensure complete die cavity fill.

From the location from which the conduit extends, the conduit passes away from the vessel, and laterally through a wall of the furnace and outwardly to a second end at the die. The conduit communicates with the die, at least in preferred forms of the invention, in a manner enabling alloy to flow upwardly in, and fill, the die cavity under the pressure head of alloy established in the vessel when the assembly is in the casting position. While not essential, it is preferable that the conduit communicates with the die cavity at a location which, with the assembly in the non-casting position, is directly below the die cavity. In any event, the die most preferably is located laterally outwardly from the vessel and at a height such that, with the assembly in its non-casting position and the die open, the level of alloy in each of the vessel and the conduit is in the same horizontal plane extending adjacent to the second end of the conduit and a fixed part of the die.

The conduit preferably is relatively long. The first part of the conduit within the furnace is heated by the furnace, thereby reducing the risk of excessive cooling of the alloy in flowing to the die. The second part of the conduit between the furnace and the die preferably is protected from excessive cooling. For this protection, the conduit can be of a refractory thermal insulating material, or the second part can be provided with an insulation sleeve. However the second part of the conduit, particularly where it is of a suitable metal such as steel, preferably is heated, such as by provision of an electric resistance coil around the second part.

The conduit may have a main part of its length from the first end which, in extending through and outwardly from the furnace, also is inclined downwardly relative to the assembly when in the non-casting position. The main part may, for example, be inclined at an angle of from about 5° to 15° from the horizontal. From the end of main part remote from the vessel, the conduit has a shorter part which extends upwardly to the die such as substantially vertically. The relative lengths of the main and shorter parts, and the angle at which the main part is inclined downwardly from the horizontal, are such that a relatively small angle of pivoting is necessary to enable the assembly to pivot between the non-casting and casting positions. The angle of pivoting may, for example, be from about 15° to 30°, such as from about 20° to 25°. The shorter part may extend upwardly from the main part at an acute angle which substantially corresponds to the complement of the angle at which the main part is inclined from the horizontal. Alternatively, the conduit may have an intermediate part providing a curved transition from the main part to the shorter part.

The location at which the conduit extends from the vessel preferably is such as to facilitate use of a relatively small angle of pivoting between the non-casting and casting positions. As indicated above, that location most preferably is below the level of alloy in the vessel when the assembly is in the non-casting position. The vessel most preferably has an upstanding wall from which the conduit extends, with the wall preferably at not more than a small angle to the vertical with the assembly in the non-casting position. Thus, as the assembly pivots from that position, the pressure head of alloy above the location from which the conduit extends is able to increase substantially as the assembly pivots to the casting position. Also, to maximise this effect, the axis about which the assembly is pivotable may be horizontally spaced beyond the centre-line of the vessel, in a direction away from that location, such that the spacing between the axis and the location is significant relative to the length of the major part of the conduit. The spacing may, for example, be at least about 40% of that length, but preferably is in excess of about 50% of that length.

In one convenient form, the vessel comprises a trough which is U-shape in cross-sections perpendicular to the pivot axis. In that form, the conduit extends from one of opposite side walls defined by the U-shape, while the pivot axis is offset towards or, if required beyond, the other one of those walls. A vessel of that form may have a respective upwardly extending wall at each end, with those walls extending transversely with respect to the pivot axis, such as substantially vertically. In that, or in other forms, the vessel most preferably has a cover which enables maintenance, if required, of a protective atmosphere over the surface of the alloy. The cover may have an openable port through which fresh alloy is able to be supplied to the vessel. Alternatively, a syphon pipe may extend through the cover to enable maintenance of the level of alloy in the vessel by a syphon action.

The vessel may have a transverse baffle or partition which divides the interior of the vessel into two chambers or sections. Where the vessel is a trough as described above, the transverse baffle may be intermediate of and, for example, about mid-way between the end walls. The conduit is able to extend from a first one of the chambers or sections, while fresh alloy is able to be supplied to the second chamber or section. The baffle has openings therethrough, or openings are defined between an edge of the baffle and a base surface of the vessel such that fresh alloy supplied to the second chamber is able to flow through to the first chamber from which the conduit extends. The arrangement is such that solid lumps of alloy are able to be present in the second, charging chamber without impeding alloy flowing from the first, casting chamber to the conduit during a casting operation.

In one embodiment of the apparatus according to the invention, the die has a lower part by which the die is mounted on or in relation to the furnace, and an upper part which is moveable relative to the furnace for opening and closing the die. In that embodiment, the die is provided with supply means for supplying protective cover gas to the die cavity for protecting the surface of molten alloy, at the second end of the conduit, when the die is open. The supply means preferably is operable to provide protective gas to the die for flow into the die cavity on solidification of alloy therein and just prior to tilting of the assembly from the casting position to the non-casting conditions. The arrangement is such that, as molten alloy retracts from the die, a resultant reduction in pressure at the second end of the conduit enables protective gas to flow into the second end of the conduit. As will be appreciated, the protective gas is supplied at a slight positive pressure, enabling its flow into the die cavity and into the second end of the conduit. Flow of the protective gas within the die cavity to the conduit is facilitated by the inherent shrinkage of a product being cast providing a slight clearance between the surface of the product and the die surfaces defining the die cavity.

Preferably the cover gas is able to flow into the die cavity along one or more channels formed in one or each of the die parts at the parting plane. The gas may be supplied to the outer periphery of surfaces of the die parts between which the parting plane is defined. In one convenient form, the gas is supplied from a convenient source of supply to a chamber which extends around that periphery, and is able to flow from the chamber to the die cavity along a plurality of passageways defined, for example, at the parting plane of the die.

As the assembly is tilted to the casting position, alloy flowing into the die cavity displaces air and protective gas. Thus, fresh protective gas needs to be supplied to the die in each casting cycle. The apparatus preferably includes means for timing the supply of protective gas as appropriate, in response to relevant operating parameters.

The means for supplying protective cover gas preferably includes a system of passages which provide communication between a supply port of the die, to which the gas can be supplied from a source, and the die cavity. The system of passages also enables gas in the die cavity on commencing a casting operation to be purged by molten alloy flowing into the die cavity, with the purged gas discharging from the passages via a discharge port. Respective valves can be operable to close one of the ports when the other of the ports is open.

If the die remains open for a prolonged period of time, it is desirable to supply cover gas to the die end of the conduit. This may be by means of a supply hose, gun, spray can or the like.

DETAILED DESCRIPTION OF THE INVENTION

In order that the invention may more readily be understood, reference is made to the accompanying drawings, in which:

FIG. 1 is a sectional view through a casting apparatus according to the present invention, showing the apparatus in a non-casting position;

FIG. 2 corresponds to FIG. 1, but shows the apparatus in a casting position;

Figure 1:
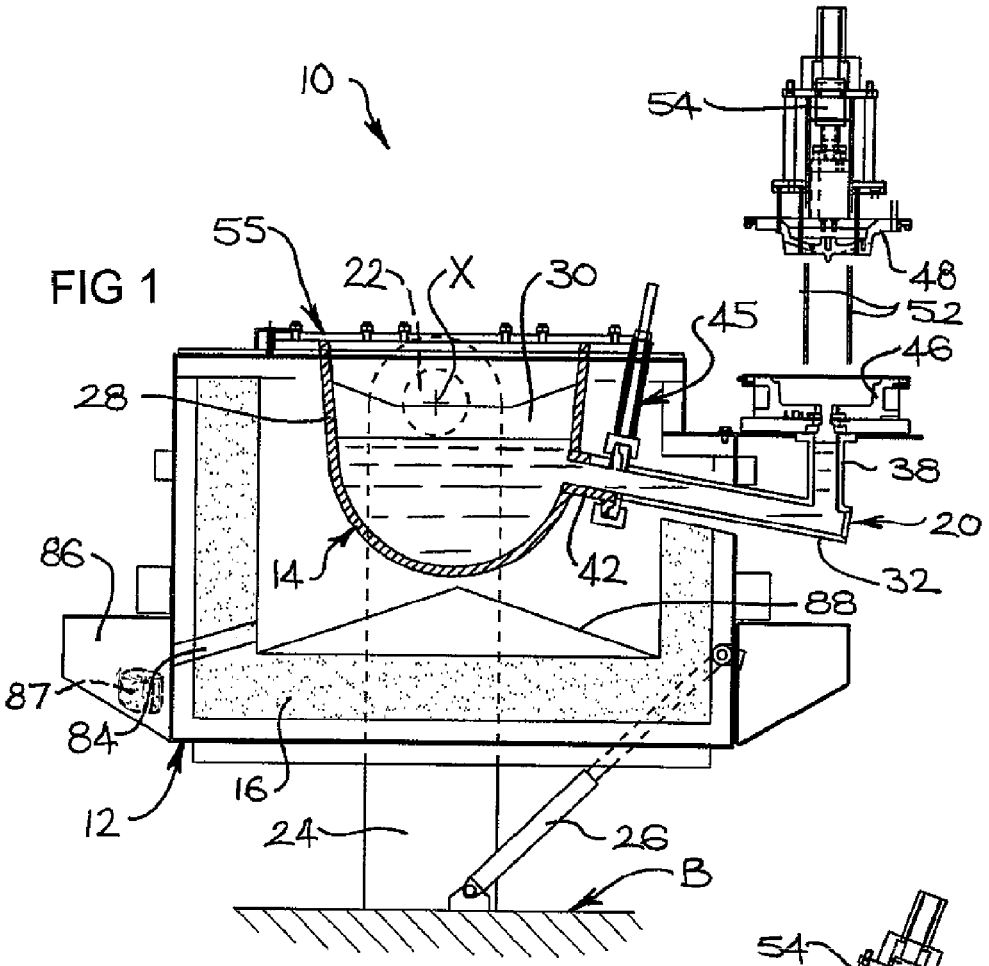
Figure 2:
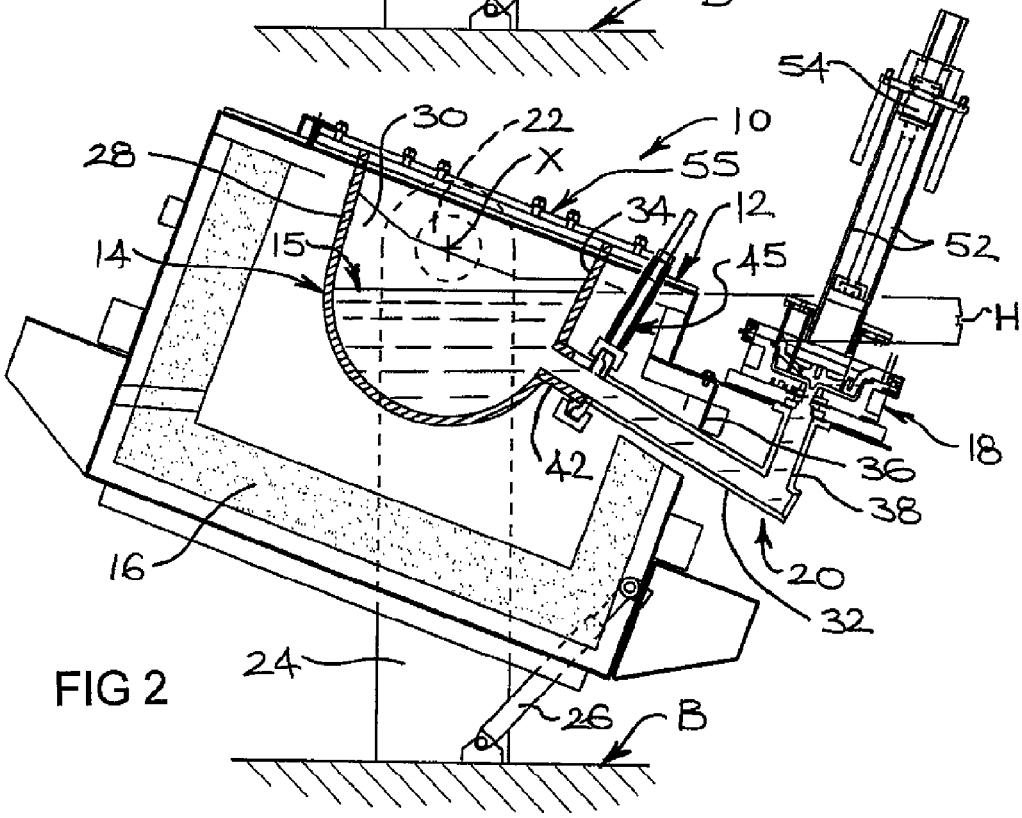
Figure 8:
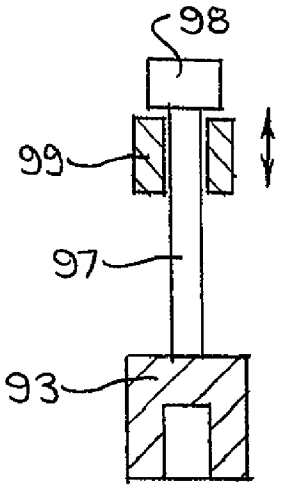
Figure 7:
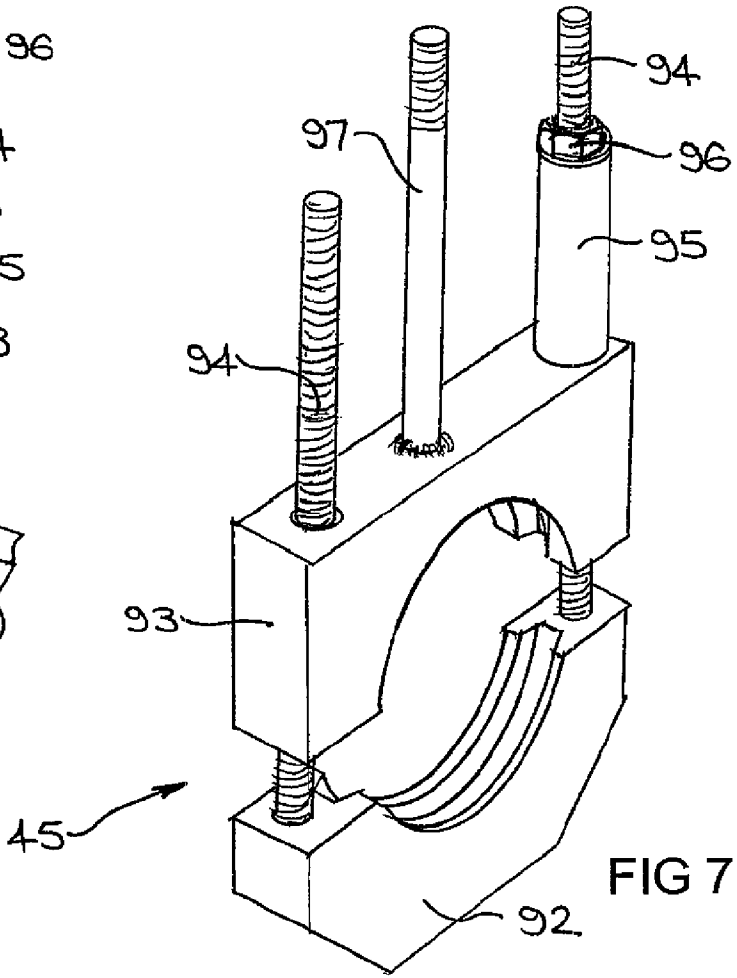
FIG. 7 is a perspective view of a component shown in FIG. 6.
Figure 9:
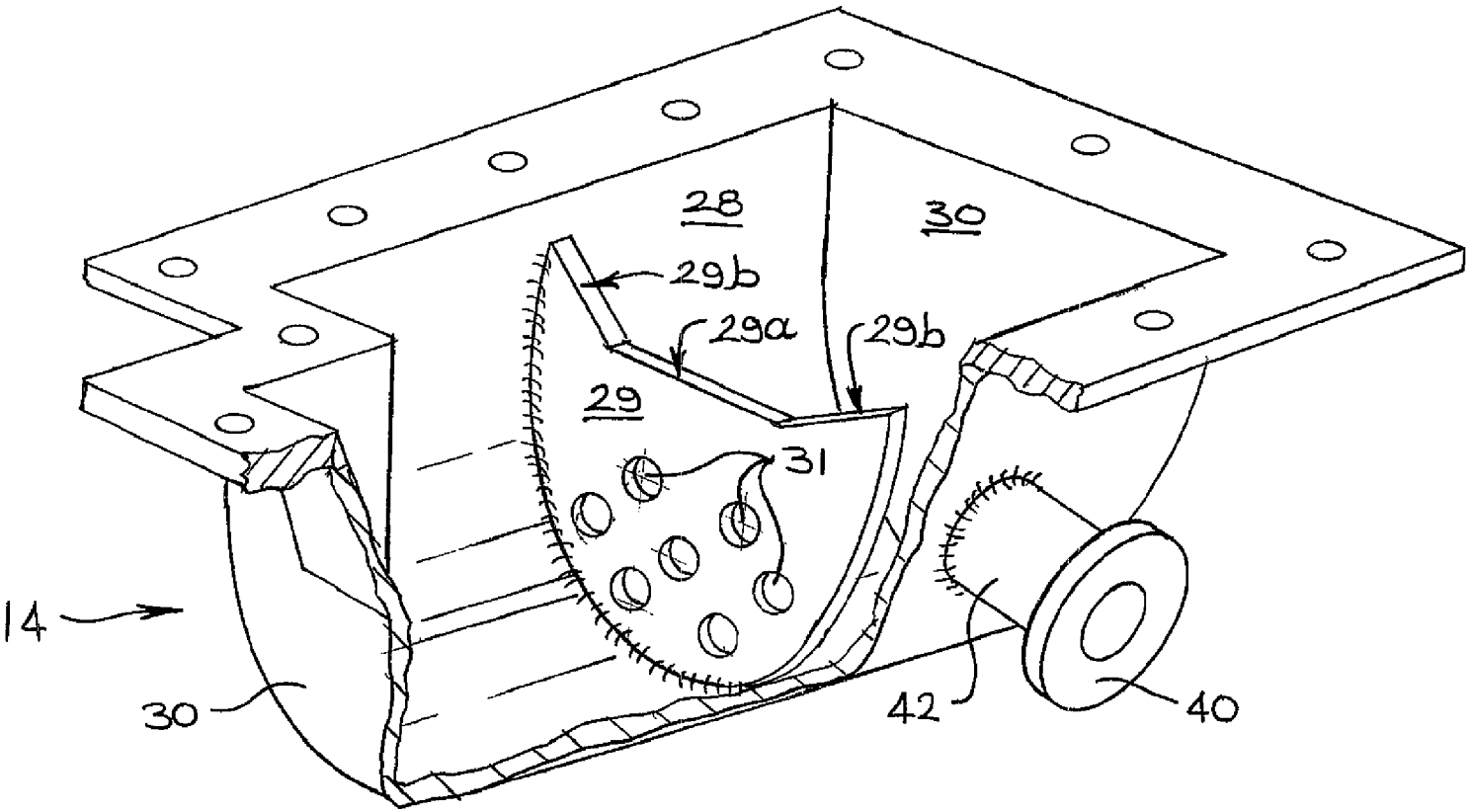
Figure 12:
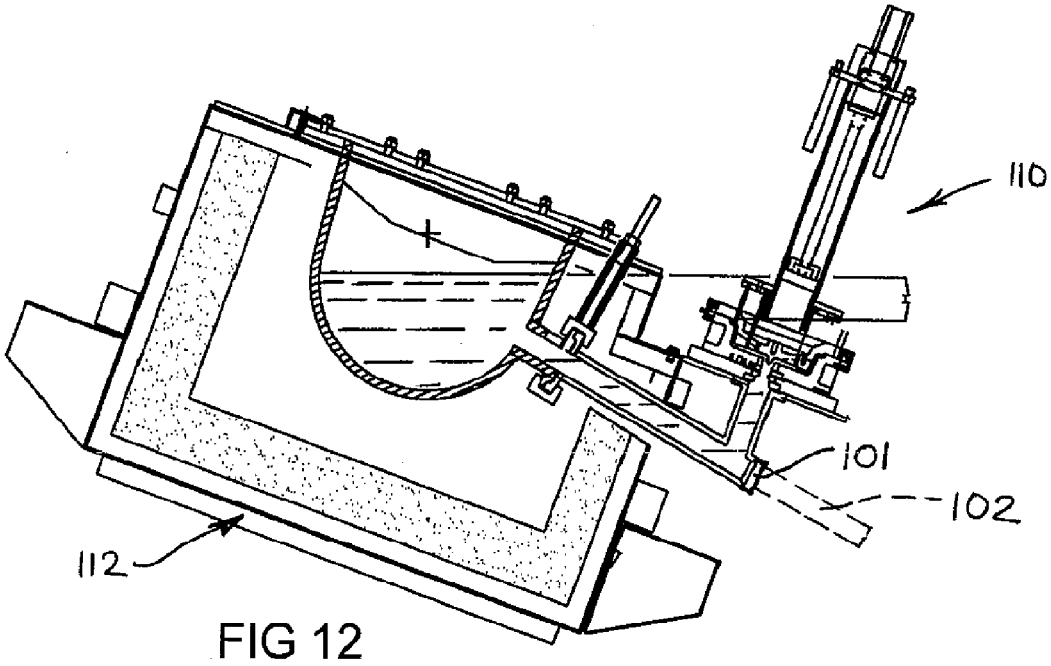
Figure 13:
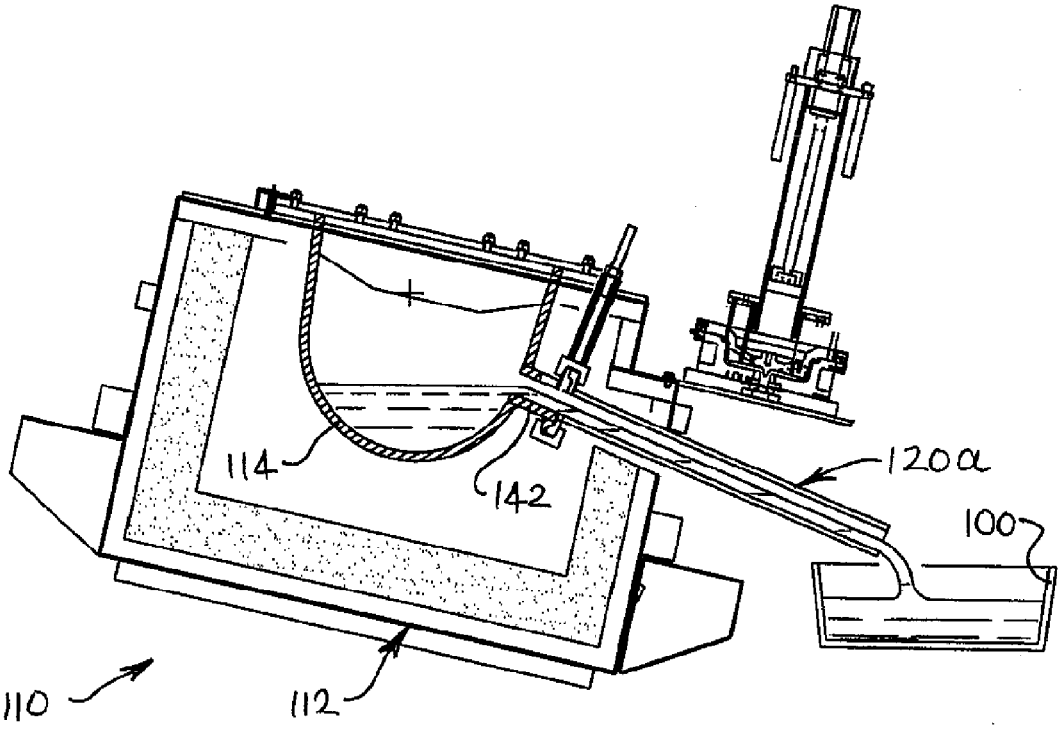
Figures 14, 15, 16:
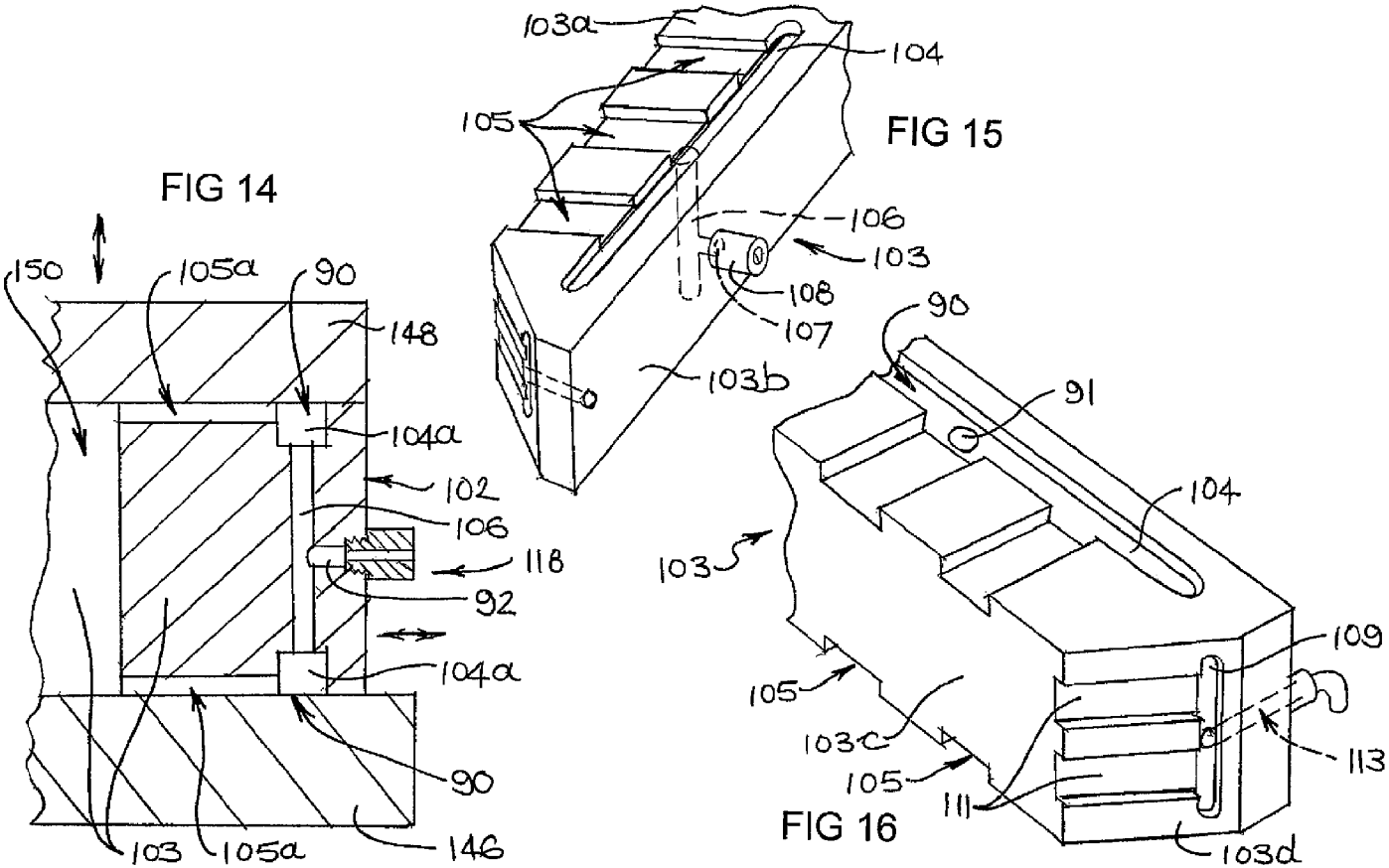

FIG. 8 schematically illustrates a mechanism for releasing the component of FIG. 7;

FIG. 9 is a cut-away perspective view of a part of the apparatus shown in FIGS. 1 and 2;

FIGS. 10 to 13 provide schematic representation of a furnace as described with reference to FIGS. 1 and 2, but in four different respective positions; and FIGS. 14 to 16 show respective views of an alternative to the control system shown in FIGS. 4 and 5.

With reference to FIGS. 1 and 2, the apparatus 10 shown therein has an assembly 12 which includes a supply vessel 14 for holding a supply of molten alloy 15 and a furnace 16 in which vessel 14 is contained and heatable for maintaining alloy 15 at a casting temperature. The assembly 12 further includes a die 18 mounted on or in relation to furnace 16, laterally outwardly from one side of vessel 14, and a conduit 20 providing communication between vessel 14 and die 18.

The assembly 12 is mounted so as to be tiltable on a substantially horizontal axis "X" which extends normal to the views depicted in FIGS. 1 and 2. To enable this, a trunnion 22 projecting from each end of furnace 16 is journalled in a respective one of a pair of stanchions 24 secured to base B. Also, at each end of furnace 16, there is a respective hydraulic ram 26 which is extendable and retractable for tilting of assembly 12.

Figure 6:
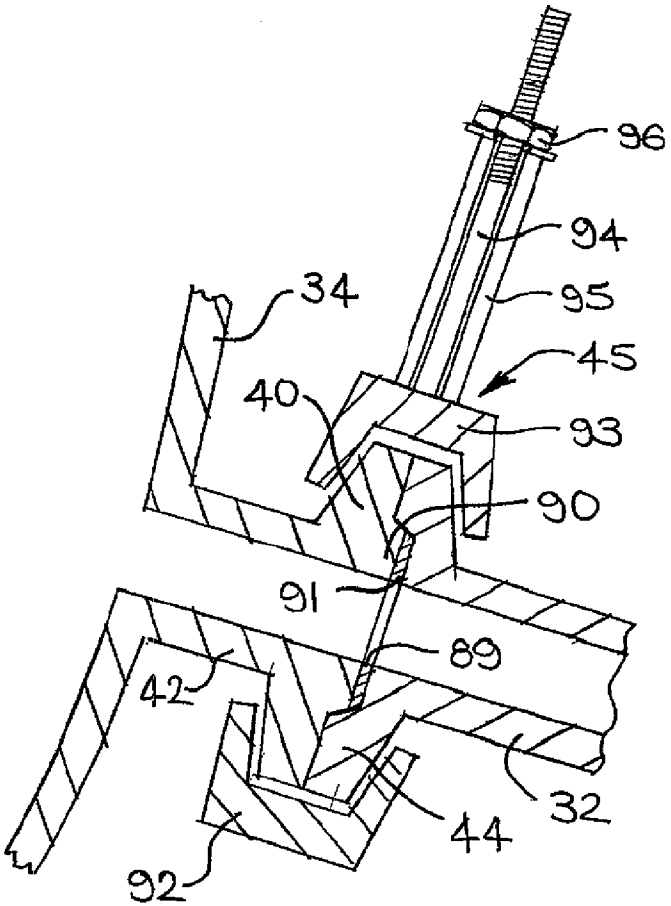
FIG. 6 shows, on an enlarged scale, a further part of the apparatus shown in FIGS. 1 and 2.

The vessel 14 is in the form of a relatively short trough defined by a U-shaped peripheral plate 28 and opposite end walls 30. Also, intermediate of end walls 30, vessel 14 has a transverse baffle on partition 29 which has openings 31 and is more fully described below. The conduit 20 has a main part 32 which extends from one side wall 34 of plate 28, through an adjacent side wall 36 of furnace 16, to a position spaced below die 18. From the outer end of part 32, conduit 20 has a shorter upwardly extending part 38 providing communication with die 18. As best seen in FIG. 6, the inner end of conduit parts 32 is connected to an annular flange 40 provided on a connector 42 of vessel 14. The flange 40 is abutted by a similar flange 44 of conduit 20, while the flanges 40 and 44 are secured together by a clamp device 45 described in more detail below.

The die 18 has a lower part 46 and an upper part 48. The part 46 is mounted on or in relation to furnace 16. In the somewhat schematic representation of FIGS. 1 and 2, part 46 is depicted essentially as mounted on the upper end of part 38 of conduit 20. However, a more typical arrangement would be for furnace 16 to have a side bracket or apron on which part 46 is supported, as schematically depicted at 49. The upper part 48 is able to be moved between the position shown in FIG. 2, in which the parts 46 and 48 define a die cavity 50 (see FIG. 3), and the raised position shown in FIG. 1. For this movement, apparatus has upstanding guides 52 on the upper ends of which a hydraulic ram 54 is mounted. The ram 54 is retractable and extendable for raising and lowering of die part 48 relative to die part 46.

The vessel 14 is designed to hold a volume of molten alloy 15 such that, with assembly 12 in the non-casting position shown in FIG. 1, the free surface of alloy 15 is above the location of at which connector 42 provides communication between vessel 14 and conduit 20. From that location, part 32 of conduit 20 extends outwardly and downwardly with respect to vessel 14. The arrangement is such that, with assembly 12 in the non-casting position, and the die 18 open (so that the outer end of conduit 20 is at atmospheric pressure), the free surface of alloy 15 in conduit 20 is just below die 18. With retraction of the hydraulic ram 26, assembly 12 is able to be tilted on axis X, clockwise with respect to the views shown in FIGS. 1 and 2, to bring assembly 12 to the casting position shown in FIG. 2. However prior to this tilting, ram 52 is extended to move upper die part 48 down to engage lower die part 46 and thereby close die 18 in readiness for a casting operation.

As assembly 12 is tilted from the non-casting position of FIG. 1 to the casting position of FIG. 2, the location at which conduit 20 extends from vessel 14 drops further below the surface of alloy 15 in vessel 14. The pressure head above that location increases to a maximum at the casting position. Also, the outer end of conduit 20 and the closed die 18 are lowered relative to the free surface of alloy 15 in vessel 14. As a consequence, alloy is caused to flow into conduit 20 under the influence of gravity and, from conduit 20 into the die cavity 50. The top of cavity 50 is below the surface of alloy in vessel 14 to an extent in the casting position that a substantial pressure head "H" exists above the cavity 50. Thus, die cavity fill is able to be achieved under a significant pressure which ensures completion of filling and a measure of shrinkage offset.

Due to the length of main part 32 of conduit 20, it is sufficient for assembly 12 to be tilted through only a relatively small angle in establishing the pressure head H on moving from the non-casting position to the casting position. The angle may be for example, from about 15° to 30°, such as from about 20° to 25°. The attainment of a substantial pressure head is assisted by the downward inclination of conduit 20 relative to vessel 14 with assembly 12 in the non-casting position, and the bent or dog-leg form of conduit 20 resulting from its mutually inclined parts 32 and 38. Development of the pressure head also is assisted by axis X being spaced beyond the centre-line of vessel 14 in a direction away from the side of vessel 14 from which conduit 20 extends, as well as by conduit 20 extending from a relatively upright portion of sidewall 34 of plate 28.

At least when casting with magnesium alloy, a protective atmosphere most preferably is provided in vessel 14 and, when die 18 is open, in the outlet end of conduit 20, in order to prevent oxidation and a risk of combustion of the alloy. In vessel 14, the volume above alloy 15 is relatively easily protected. Suitable protective gases are more dense than air and, hence, relatively easily retained, while retention of the gas is assisted by provision of a lid 55 covering vessel 14. With alloy in the upper end of part 38 of conduit 20, the matter is less straight forward. However, an arrangement as illustrated in FIGS. 3 to 5 is found to provide a beneficial result.

Figure 3:
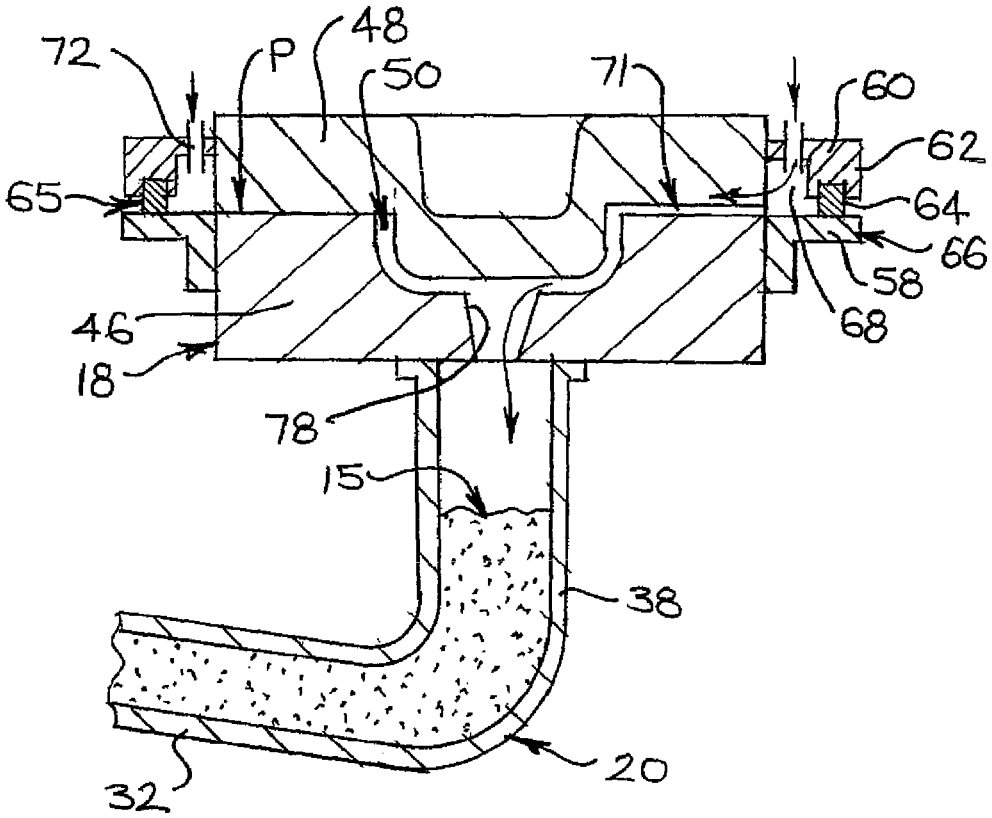
FIG. 3 shows, on an enlarged scale, part of the apparatus shown in FIG. 2.

FIG. 3 shows the die 18 just prior to the commencement of tilting of assembly 12 from the non-casting position. Thus, the die 18 is closed. FIG. 4 shows the situation after return of assembly 12 to the non-casting position, just prior to opening of die 18 for release of a casting 56 from die cavity 50.

Figure 5:
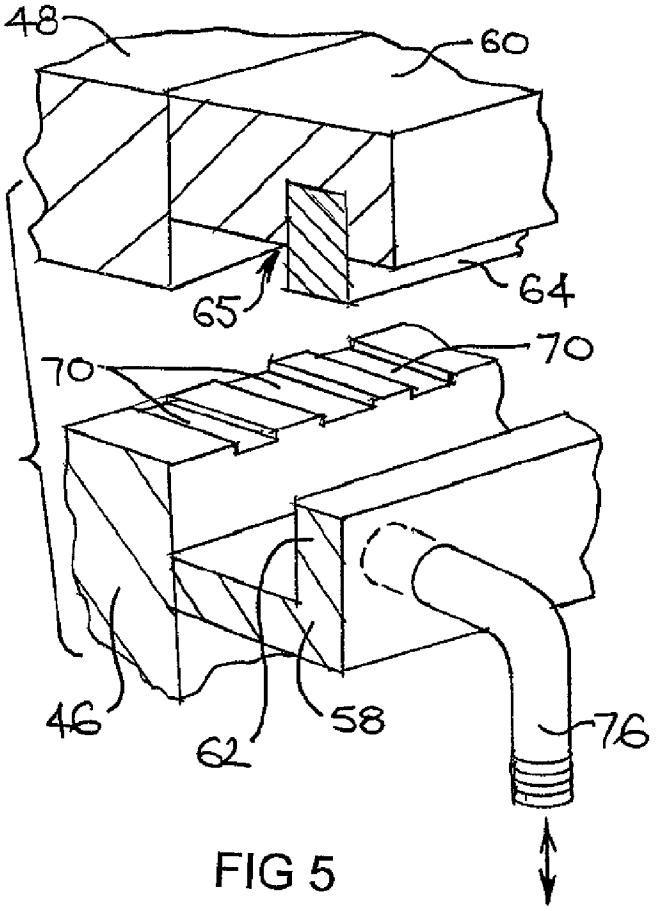
FIG. 5 is an enlarged, exploded perspective view of part of the arrangement of FIG. 4.
Figure 4:
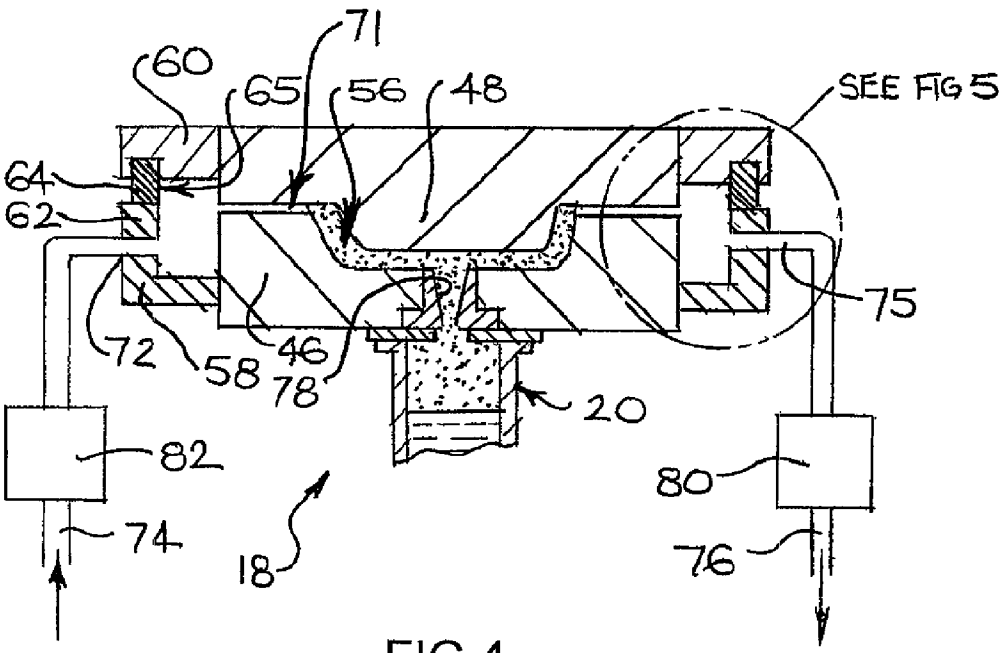
FIG. 4 is similar to FIG. 3, but shows part of a control system in a slightly modified arrangement.

As shown in FIGS. 3 to 5, each lower and upper die parts 46 and 48 has a respective peripheral flange 58 and 60. In FIG. 3, the flange 60 of die part 48 has a down-turned outer rim 62, while a seal 64 is fitted around a groove 65 in the lower edge of rim 62 for bearing against the upper face of flange 58 of part 46. In FIGS. 4 and 5, the flange 58 of part 46 has an upturned outer rim 62, while a seal 64 for bearing against the upper edge of rim 62 is fitted around a groove 65 in the lower face of flange 60 of part 48. The arrangement is such that, with die 18 closed to bring parts 46 and 48 into contact on parting plane P, the flanges 58 and 60 form a manifold 66. In manifold 66, a chamber 68 is defined around the periphery of die parts 46 and 48 and through which plane P extends. Around the die cavity 50, chamber 68 and cavity 50 are in communication by a plurality of slots 70 formed in the surface of at least one of parts 46 and 48—in part 46, in the arrangement illustrated—to define thin passageways 71 between cavity 50 and chamber 68.

Manifold 66 includes at least one connector 72 which communicates with chamber 68. Connector 72 is connectable to a supply line 74 by which protective cover gas is able to be supplied to chamber 68. Also, manifold 66 includes at least one connector 75 through which gas is able to discharge from chamber 68 for collection via discharge line 76.

As previously indicated, the surface of alloy 15 in conduit 20, with assembly 12 in the non-casting position and die 18 open, is just below die 18. This remains the case on closing die 18, prior to tilting from that position, as illustrated in FIG. 3. As the assembly 12 is tilted to the casting position, the alloy rises in conduit 20, enters the die via inlet sprue 78 and flows into and fills die cavity 50. In the processes of obtaining die cavity fill, the alloy displaces gas present in the outlet end of conduit 20 and in cavity 50. The displaced gas passes along passageways 71 to chamber 68. From chamber 68, the displaced gas is discharged via line 76. To enable this, a valve 80 in line 76 is opened, while a valve 82 in line 74 is closed. The valves 80 and 82 preferably are solenoid valves.

On solidification of a casting 56 produced by die cavity fill in tilting to the casting position, alloy solidifies back from the casting to a narrow neck at the inlet to sprue 78. On completion of this solidification the assembly 12 is returned to the non-casting position. As the assembly is tilted away from the casting position, still molten alloy in conduit 20 is drawn back toward vessel 14, tending to create a void between the surface of molten alloy in conduit 20 and solidified alloy in sprue 78.

Prior to the commencement of tilting from the casting position, valve 80 is closed and valve 82 is opened. With opening of valve 82, protective gas is supplied into chamber 68, and the protective gas is able to pass via passageways 71 and the die cavity 50, into the end of conduit 20. This is enabled by the shrinkage of alloy in cavity 50 on solidification providing a sufficient slight clearance around the resultant casting 56 for the flow of protective gas from passageways 71, around the casting 56 and sprue metal to conduit 20. Also, the protective gas necessarily is supplied at a pressure in excess of atmospheric pressure for its supply into chamber 68 while, as indicated, retracted alloy in conduit 20 tends to create a reduction in pressure is generated in conduit 20.

When assembly 12 is returned to the non-casting position, the valve 82 is closed. The die part 48 then is raised and the casting is removed. However, even though the die 18 is open, the protective gas is able to be sufficiently retained in the end of conduit 20 due to it being more dense than air. The gas thus is able to protect the upper surface of alloy in conduit 20 from oxidation during the relatively short interval between casting cycles.

In addition to being operable to tilt assembly 12 between the casting and non-casting positions, ram 26 is able to be operated to tilt assembly 12 to a storage position. For this, ram 26 is extended to an extent greater than necessary to return assembly 12 from the casting to the non-casting position. That is, assembly 12 is tilted anti-clockwise, relative to the views of FIGS. 1 and 2 beyond the non-casting position of FIG. 1. The angle through which the assembly 12 is tiltable from the non-casting to the storage position needs to be sufficient to enable all alloy in conduit 20 to flow back into vessel 14.

The storage position is able to be used on completion of a casting campaign. Alloy which solidifies in the vessel 14 is able to be remelted by heat energy input from furnace 16. However, alloy should not be permitted to solidify in conduit 20, due to difficulty in remelting it. Tilting of assembly 12 to the storage position enables avoidance of solidification of alloy in conduit 20.

Tilting to the storage position also can be used in the event of a failure of vessel 14 which allows molten alloy to drain into furnace 16. As shown, furnace 16 has a drainage port 84 which, with assembly 12 in the storage position, enables molten alloy to be drained into a chamber 86 mounted along the side of furnace 16 remote from die 18. The chamber 86 may be provided with flux 87 suitable for forming a slag with molten alloy. As the chamber 86 is able to remain relatively cool, the flux may be kept in plastic bags which melt on contact with the alloy to release their contents. The sloping base 88 facilitates draining of alloy into chamber 86.

Conduit 20 may necessitate removal for service or replacement from time to time. This is facilitated by clamp device 45 and the arrangement shown in FIG. 6. As shown in FIG. 6, the faces of flanges 40 and 44 interfit due to flange 44 having a recessed seat 89 and flange 40 having a projecting central hub 90. A corrugated gasket 91 is provided between seat 89 and hub 90, and the flanges 40 and 44 are urged together by device 45 to achieve a seal at gasket 91.

Each flange 40 and 44 has a tapered outer side face. The device 45 has an opposed pair of clamp members 92 and 93, each of which defines a semi-circular groove in which flanges 40 and 44 are able to seat. The lower member 92 has a parallel pair of threaded rods 94 projecting therefrom, and through holes in the upper member 93. Above member 93, a compression spacer tube 95 is fitted on each rod 94 such that a nut 96 tightened on the rod 94, down onto the tube 95, draws the members 92 and 93 together. The groove in each of members 92 and 93 has tapered sides which bear against tapered sides of flanges 40 and 44. Thus, tightening the nuts 96 or rods 94 serves to force the flanges 40 and 44 firmly together to grip gasket 91.

As shown in FIGS. 1 and 2, the upper ends of rods 94 and tubes 95 project through the tops of furnace 16. Thus, nuts 96 readily are able to be tightened or released, as required. Also, as best seen in FIG. 7, the upper member 93 has a rod 97 which projects upwardly between rods 94. The rod 97 serves as a handle for use in manoeuvring device 45. However, as shown in FIG. 8, a nut 98 can be provided on the threaded upper end of rod 97, after positioning a heavy sleeve 99 on rod 97, with the arrangement being operable as an impact hammer for use in separating members 92 and 93 after loosening nuts 96.

With reference to FIG. 9, the perspective view of vessel 14 shown therein is cut-away to show baffle 29. The baffle is shaped to conform to the inner U-shaped surface of plate 28, and is secured in position by welding to plate 28. Baffle 29 is substantially parallel to and located mid-way between end walls 30 of vessel 14. Thus, the interior of vessel 24 is divided into a first chamber 14*a* from which conduit 20 extends, and a second chamber 14*b*. Fresh alloy is able to be supplied to the chamber 14*b* and, to maintain the molten alloy in chamber 14*a* at a required level, the holes 31 are provided in baffle 29 to enable alloy to flow from chamber 14*b* to chamber 14*a*. Baffle 29 has an upper edge which, relative to assembly 12 in the non-casting position, has a substantially horizontal mid-section 29*a* and, at each end of the mid-section 29*a*, an outwardly and upwardly inclined end section 29*b*. The required level of alloy in vessel 14 is such that it is below the mid-portion of 29*a* with the assembly 12 in the non-casting position and below a respective end portion 29*b* with assembly 12 in each of the casting and storage positions.

With reference to each of FIGS. 10 to 13, the apparatus 110 shown therein is very similar to the apparatus 10 of FIGS. 1 and 2. The structure of and casting operations with apparatus 110 generally will be understood from the description of FIGS. 1 and 2. To the extent that it is necessary to refer to components of the apparatus 110, they have the same reference numeral as the corresponding components of apparatus 10, plus 100. However, staunchens and a ram corresponding to staunchens 24 and ram 26 of FIGS. 1 and 2 have been omitted for simplicity of illustration.

Figure 11:
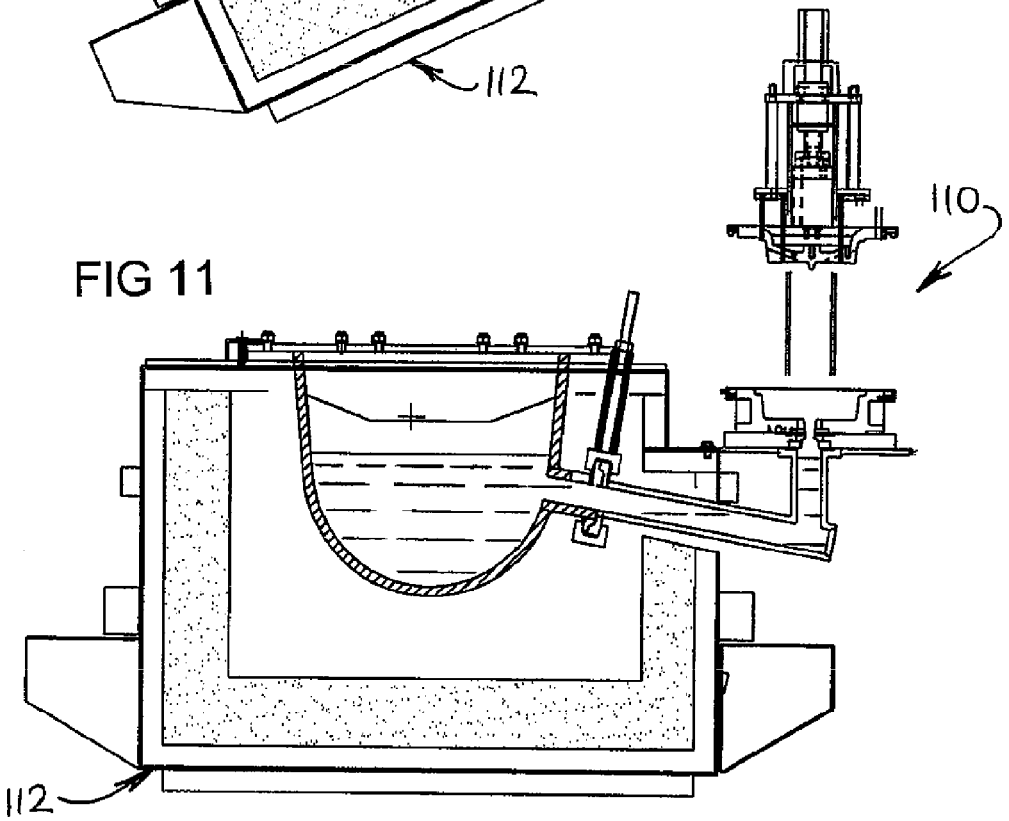

FIGS. 11 and 12 show the apparatus 110 respectively in a non-casting position corresponding to that of FIG. 1 and a casting position corresponding to that of FIG. 2. Thus, in FIG. 11, the assembly 112 is in the non-casting position, ready for movement to the casting position shown in FIG. 12. The aspects of operation in movement between these positions are essentially as described in relation to FIGS. 1 and 2.

Figure 10:
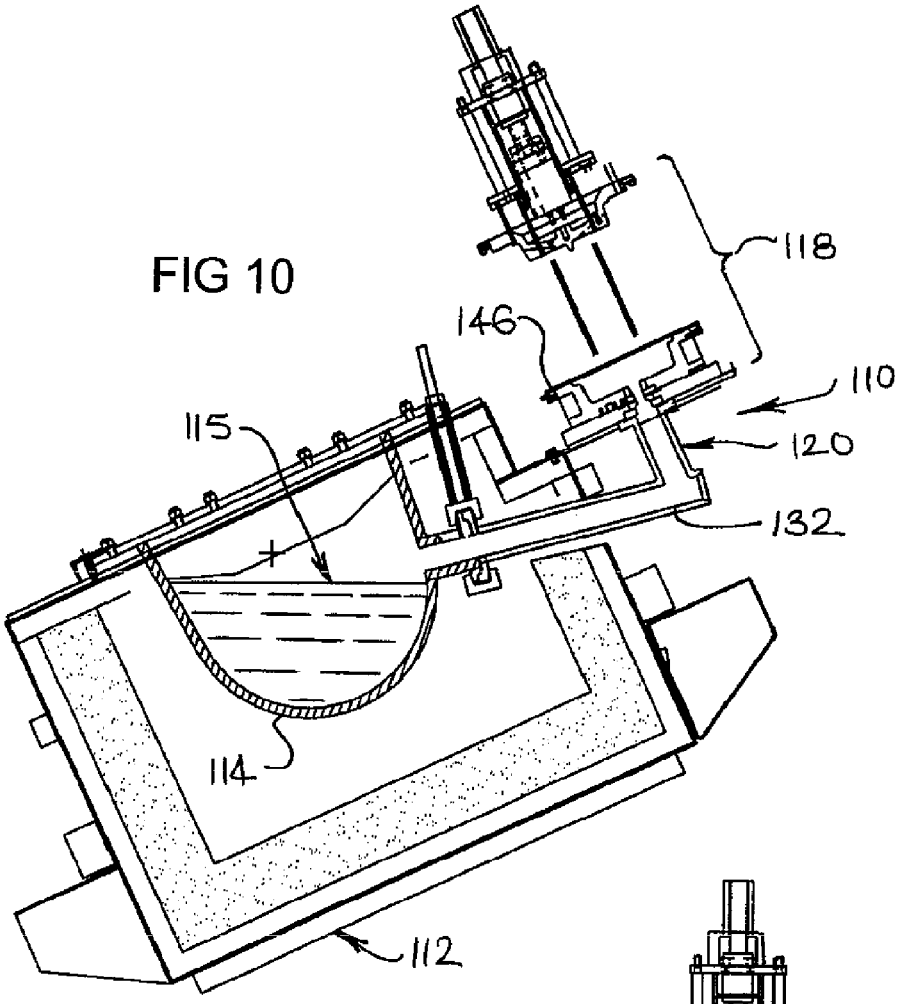

FIG. 10 shows the apparatus 110 after having been moved from the casting position of FIG. 12 to the non-casting position of FIG. 11, and then beyond the non-casting position to a park or storage position. In the latter position, which may be assumed for example at the end of a casting campaign, the main part 132 of conduit 120 is inclined upwardly from vessel 114 such that it is slightly above horizontal. As a consequence, alloy 115 has drained back from the lower die part 146 of open die 118, and from conduit 120, into vessel 114.

FIG. 13 shows the assembly 112 in an emptying position. The assembly is moved to this position from the park or storage position of FIG. 10, by tilting the assembly through the non-casting position of FIG. 11 and to and beyond the casting position of FIG. 12. However, prior to leaving the park or storage position, the conduit 20 is modified. This can be by a number of different arrangements. In a first arrangement, the clamp device 145 is loosened to enable the conduit 120 to be removed, after which it is replaced by another conduit 120*a*. As shown in FIG. 13, conduit 120*a* is straight and provides an in-line continuation of connector 142 of vessel 114. The arrangement is such that, as assembly 112 is tilted to its emptying position, alloy is able to discharge from vessel 114 to be received in a suitable receptacle 100. In FIG. 13, assembly 112 is shown part-way to its emptying position. Assembly 112 needs to tilt further beyond the casting position of FIG. 12 to reach the emptying position in which all alloy in vessel 114 is able to discharge into receptacle 100.

In a second arrangement, illustrated in FIG. 12, the end of the main part 132 remote from connector 142 has a removable cap 101. When it is required to empty vessel 114, cap 101 is removed with the assembly 112 in the park position of FIG. 10, and an in-line short conduit 102, shown in broken outline in FIG. 12, then is fitted. As a further variant, 101 denotes a valve member to which conduit 102 can be attached. The valve member 101 enables conduit 102 to be fitted with assembly in any position, with the valve member 101 being adjustable between positions in which it prevents or enables flow through conduit 102.

FIGS. 14 to 16 show an alternative to the arrangement of FIGS. 4 and 5, both in respect of the form of the die and the system for distributing protective gas and displacing atmospheric gas. Parts of the arrangement of FIGS. 14 to 16 which correspond to those of FIGS. 4 and 5 have the same reference numeral, plus 100.

FIG. 14 shows a part sectional view of a die 118 having lower and upper die parts 146 and 148 and, between parts 146 and 148 when the die 118 is closed, a peripheral die body assembly 102. The parts 146 and 148 with body assembly 102 together define a die cavity 150. Thus, rather than there being a parting plane at which parts 146 and 148 meet, each of parts 146 and 148 meets a respective surface of body assembly 102.

The body assembly 102 includes a plurality of elongate members 103, of which part of one is shown in each of FIGS. 15 and 16. The members 103 have mitered ends at which adjacent members 103 meet. Also the members 103 define a flow system which enables the supply of protective gas to and the purging of atmospheric gas from the die cavity 150.

In the upper and lower surfaces 103*a* of each member 103, there is defined a longitudinal groove 104 adjacent to the outer face 103*b*. From each groove 104, a plurality of shallow, but relatively wide channels 105 extend to the inner, die cavity defining face 103*c*. A bore 106 provides communication between each groove 104, while an inlet port 107 at the outer face 103*b* communicates with bore 106. With the die closed, as shown in FIG. 14, each groove 104 and its channels 105 are covered by the adjacent one of die parts 146 and 142, to define longitudinal passage 104*a* and shallow passages 105*a*, respectively. The arrangement is such that gas is able to flow from a gas flow line partly shown at 108, through port 107 to passage 104*a* and then, via passages 105*a*, into the die cavity 150, or from cavity 150 in the reverse direction for discharge through line 108.

At one mitered end 103*d* of each member 103, each end 103*d* of each alternate member 103, or each end 103*d* of each member 103, there is a similar facility for gas flow. Thus, as shown in FIGS. 15 and 16, there is a vertical groove 109 adjacent to the outer face 103*b* and a plurality of shallow, but relatively wide channels 111 which extend from the groove 109 to the inner face 103*c*. A port 113 communicating with groove 109 enables a flow of gas to or from the die cavity 150. With the die closed, the opposed ends of adjacent members 103 abut so that the groove 109 and channels 111 provide a passageway between the die cavity 150 and port 113.

The arrangement is similar to that described reference to FIGS. 4 and 5. Thus, the flow system for at least one member 103 may have its gas flow line 108 connected to a source of supply of protective cover gas to be supplied to the die cavity when required, with at least one other member 103 having its line 108 enabling discharge of gas from a cavity 150 when required. In this case, the facility for gas flow at mitered ends 103*d* may be inter-connected with the system for flow in line 108. A number of arrangements are possible, although the overall requirement is that the die cavity 150 is able to be purged of gas by incoming alloy, and to receive protective gas, when required.

A number of significant practical benefits of the casting apparatus of the present invention will be understood from the description with reference to the drawings. Thus, apparatus significantly extends the capability, and reduces the cost, of permanent mold casting for a wide range of components, including high-performance components. Also, the apparatus enables low capital, tooling and running costs, while it is amendable to electric resistance heating. The apparatus has a small machine footprint, while it can avoid the need for ladling through the air, and requires no applied pressure to fill the die cavity. The apparatus enables a high yield of cast metal, typically about 95%.

The casting apparatus is found to enable production of high-integrity castings which can be heat treatable and weldable. Castings with complex internal shapes are possible, using sand cores. The apparatus is suitable for small to large production quantities for a wide range of products for the automotive and other industries.

Castings (produced with apparatus according to the invention) are found to have excellent finish out of the die, with no flow lines or discolouration and good overall cosmetic appearance. The castings have excellent surface detail and definition, and are free of misruns. Also, machined castings display good, bright finish. The measured tensile properties for castings produced with the apparatus are found to equal or exceed comparable reported properties for gravity permanent mold-cast alloy, such as AZ-91.

The apparatus of the present invention enables cycle times which are faster than equivalent magnesium gravity permanent mould castings, with no risers needed. Also, the cycle times are significantly faster than equivalent aluminium gravity permanent mold castings. Additionally, consumable costs generally are low, such as with protective cover gas, while commercially available die coat can be used. Casting wall thicknesses are typical of permanent mold casting. Also, labour costs can be kept to a low level.

Finally, it is to be understood that various alterations, modifications and/or additions may be introduced into the constructions and arrangements of parts previously described without departing from the spirit or ambit of the invention.

The invention claimed is:

1. A casting apparatus which enables gravity flow and feeding of alloy in a casting operation, the apparatus comprising:

a supply vessel for holding a supply of alloy, a furnace in which the vessel is contained and in which the vessel is heatable to maintain the supply of alloy at a suitable casting temperature, a permanent mould located outside of the vessel and the furnace mounted laterally outwardly from the vessel and the furnace, the mould having dies defining a die cavity, a conduit providing communication between the vessel and the mould, the conduit having a main part of its length which extends through and outwardly from the furnace and slopes downwardly relative to the vessel, and a drive element operable to reversibly tilt an assembly including the furnace, the vessel and the mould about a substantially horizontal axis to enable or prevent the flow of the alloy through the conduit from the vessel to the die cavity defined by the dies under a pressure head of alloy in the supply vessel, and throughout a range of tilting of the assembly, from a first, non-casting position the assembly occupies on completion of one cycle and before commencement of the next cycle and in which the flow of alloy from the vessel to the die cavity is prevented, to a second, casting position enabling flow from the vessel to the die cavity, to generate the pressure and produce a casting, the mould having a lower die by which alloy is able to be received upwardly into the die cavity by flowing upwardly from the conduit and by which the mould is mounted in relation to the furnace, and an upper die which is moveable relative to the lower die and the furnace for opening and closing the mould, the mould being provided with an arrangement connectable to a source of supply of protective cover gas and enabling the flow of protective cover gas to the die cavity for protecting a surface of molten alloy, at a second end of the conduit, said arrangement including a chamber into which the protective gas is receivable, said arrangement having a plurality of outlets by which the chamber communicates with the die cavity, said arrangement being operable to provide protective cover gas at a positive pressure to the mould for flow into the die cavity on solidification of alloy therein and just prior to tilting of the assembly from the second, casting position to the first, non-casting position whereby, as molten alloy retracts from the mould as the pressure head is reduced, the positive pressure of protective cover gas and a resultant reduction in pressure at the second end of the conduit enabling protective cover gas to flow into the second end of the conduit for protecting the surface of molten alloy in the second end of the conduit, when the mould is open, wherein the main part of the conduit slopes at an angle of from about 5° to 15° from a top horizontal surface of the vessel.

2. The apparatus of claim 1, wherein the drive element operable to reversibly tilt the assembly is operable for tilting the assembly to a third, storage position which is beyond the first, non-casting position in a direction away from the casting position and in which alloy in the conduit is able to drain into the vessel.

3. The apparatus of claim 2, wherein the drive element to tilt the assembly is operable for tilting the assembly away from the third, storage position, through and beyond the second, casting position to a fourth, alloy emptying position.

4. The apparatus of claim 1, wherein the vessel is able to hold a volume of molten alloy which is substantially larger than the volume of alloy consumed in a casting cycle.

5. The apparatus of claim 1, wherein the conduit has a first end at the vessel at a location which is below the level of alloy in the vessel when the assembly is in the first, non-casting position, whereby a pressure head of molten alloy above that location is able to be maintained during pivoting of the assembly from the first, non-casting position to the second, casting position and whereby the pressure head of alloy increases as the assembly tilts from the first, non-casting to the second, casting position.

6. The apparatus of claim 5, wherein with the assembly in the second, casting position, the pressure head is at a maximum, with the level of alloy in the vessel sufficiently above the highest point in the die cavity to ensure complete die cavity fill.

7. The apparatus of claim 5, wherein, from the location for the first end of the conduit, the conduit passes away from the vessel, and laterally through a wall of the furnace and outwardly to a second end at the mould, and wherein the conduit communicates with the mould in a manner enabling alloy to flow upwardly in, and fill, the die cavity under the pressure head of alloy established in the vessel when the assembly is in the second, casting position.

8. The apparatus of claim 7, wherein the conduit communicates with the die cavity at a location which, with the assembly in the first, non-casting position is directly below the die cavity.

9. The apparatus of claim 1, wherein a first part of the conduit within the furnace is heatable by the furnace, thereby reducing the risk of excessive cooling of the alloy in the flowing to the die, and a second part of the conduit between the furnace and the mould is protected from excessive cooling.

10. The apparatus of claim 9, wherein the conduit is of a refractory thermal insulating material.

11. The apparatus of claim 9, wherein the second part of the conduit is heatable by an electric resistance coil around the second part.

12. The apparatus of claim 9, wherein the second part of the conduit is provided with an insulation sleeve.

13. The apparatus of claim 1, wherein the relative lengths of the main part remote from the vessel has a shorter part which extends upwardly to the lower die.

14. The apparatus of claim 13, wherein the relative lengths of the main and shorter parts, and the angle at which the main part slopes downwardly from the horizontal, are such that an angle of pivoting of from 15° to 30° is necessary to enable the assembly to pivot between the first, non-casting and second, casting positions.

15. The apparatus of claim 1, wherein the vessel includes a trough which is U-shape in cross-sections perpendicular to the pivot axis, the conduit extends from one of the opposite side walls defined by the U-shape, and the pivot axis is offset from the center of the vessel towards the other one of the walls.

16. The apparatus of claim 15, wherein the vessel has a cover which enables maintenance of a protective atmosphere over the surface of the alloy.

17. The apparatus of claim 15, wherein the vessel has a transverse baffle or partition which divides the interior of the vessel into two chambers or sections, the conduit extends from a first chamber or section of the two chambers or sections, and the vessel is adapted for fresh alloy to be supplied to the second chamber or section.

18. The apparatus of claim 17, wherein the baffle enables fresh alloy supplied to the second chamber or section to flow through to the first chamber or section from which the conduit extends, while preventing solid lumps of alloy present in the second chamber or section from impeding alloy flowing from the first chamber or section to the conduit during a casting operation.

19. The apparatus of claim 1, wherein the protective cover gas is able to flow into the die cavity along one or more channels formed in one or more of the dies at a parting plane.

20. The apparatus of claim 19, wherein the chamber of said arrangement, by which the protective gas is able to be supplied, extends around the periphery of the mould for flow from the chamber to the die cavity along a plurality of passageways, each terminating at a respective one of said outlets.

21. The apparatus of claim 1, wherein the apparatus includes a timer operable to time the supply of protective gas, in response to casting operating parameters.

* * * * *